US011843184B1

(12) United States Patent
Densmore et al.

(10) Patent No.: US 11,843,184 B1
(45) Date of Patent: Dec. 12, 2023

(54) DUAL BAND, SINGULAR FORM FACTOR, TRANSMIT AND RECEIVE GNSS ANTENNA WITH PASSIVELY SHAPED ANTENNA PATTERN

(71) Applicant: General Dynamics Mission Systems, Inc., Fairfax, VA (US)

(72) Inventors: Arthur Densmore, Fairfax, VA (US); Sayuj Haridas, Fairfax, VA (US)

(73) Assignee: General Dynamics Mission Systems, Inc.

( * ) Notice: Subject to any disclaimer, the term of this patent is extended or adjusted under 35 U.S.C. 154(b) by 0 days.

(21) Appl. No.: 17/807,088

(22) Filed: Jun. 15, 2022

(51) Int. Cl.

| | |
|---|---|
| ***H01Q 5/30*** | (2015.01) |
| ***H01Q 1/38*** | (2006.01) |
| ***H01Q 9/04*** | (2006.01) |
| ***H01Q 5/307*** | (2015.01) |

(52) U.S. Cl.
CPC ..... *H01Q 5/307* (2015.01); *H01Q 9/0428* (2013.01)

(58) Field of Classification Search
CPC ..... H01Q 1/38; H01Q 5/30; H01Q 5/307; H01Q 9/04; H01Q 9/0428
See application file for complete search history.

(56) References Cited

U.S. PATENT DOCUMENTS

| | | | | |
|---|---|---|---|---|
| 6,937,193 | B2 * | 8/2005 | Hendler | H01Q 1/38 343/846 |
| 8,810,470 | B2 * | 8/2014 | Heckler | H01Q 1/243 343/846 |
| 8,912,974 | B2 * | 12/2014 | Green | H01Q 9/0478 343/860 |
| 9,287,628 | B2 * | 3/2016 | Zeng | H01Q 1/38 |
| 9,490,538 | B2 * | 11/2016 | Hsu | H01Q 9/0407 |
| 9,590,313 | B2 * | 3/2017 | Jan | H01Q 9/0435 |
| 11,165,167 | B2 * | 11/2021 | Rentz | H01Q 9/26 |
| 11,476,578 | B2 * | 10/2022 | Chivukula | H01Q 21/065 |

* cited by examiner

*Primary Examiner* — Tho G Phan
(74) *Attorney, Agent, or Firm* — LKGLOBAL | Lorenz & Kopf, LLP

(57) ABSTRACT

The dual frequency antenna element has electromagnetically resonant structure with plural attached current conductors each communicating on a different frequency band and producing a circularly polarized radiation pattern with respect to a propagation direction. A pattern shaper element fashioned using first and second conductive discs is positioned within the radiation pattern in alignment with the propagation direction. The discs are secured in a first spaced relation to each other and in a second spaced relation to the dual frequency antenna element. The respective disc surface areas, and the first and second spaced relations are cooperatively configured to passively modify the radiation pattern of the dual frequency antenna element to produce dual frequency band coverage of approximately 60 degrees centered about the longitudinal axis while substantially blocking coverage at 90 degrees to the longitudinal axis.

10 Claims, 4 Drawing Sheets

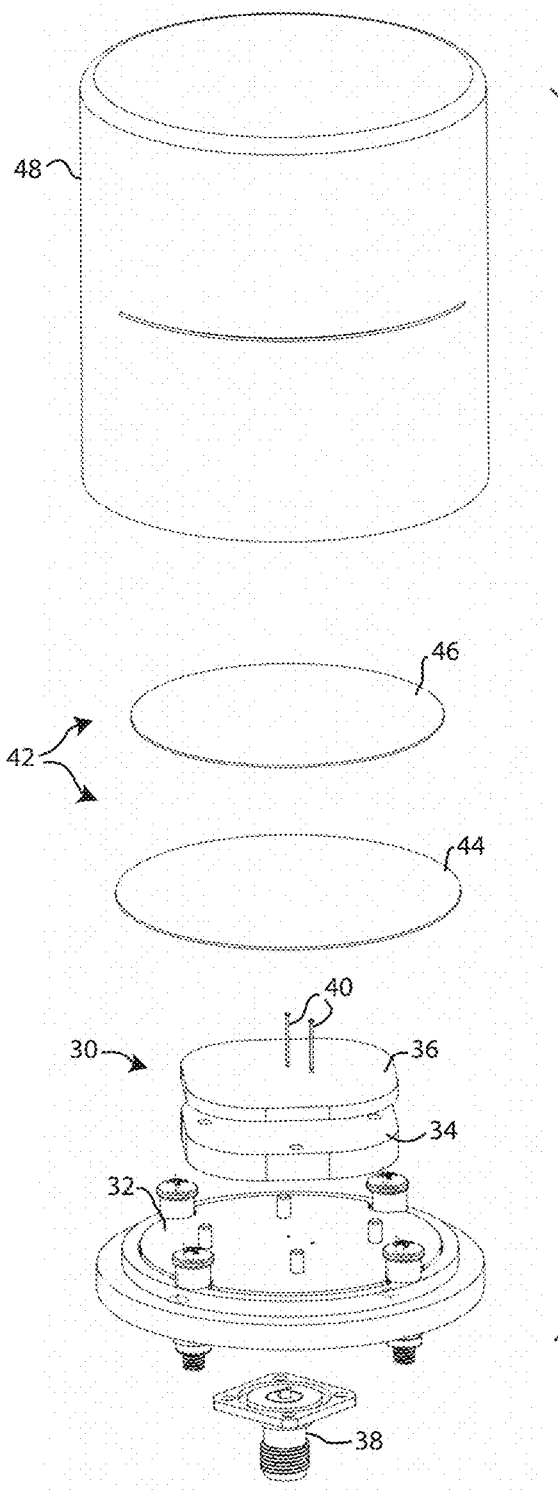
Fig. 4
Fig. 5
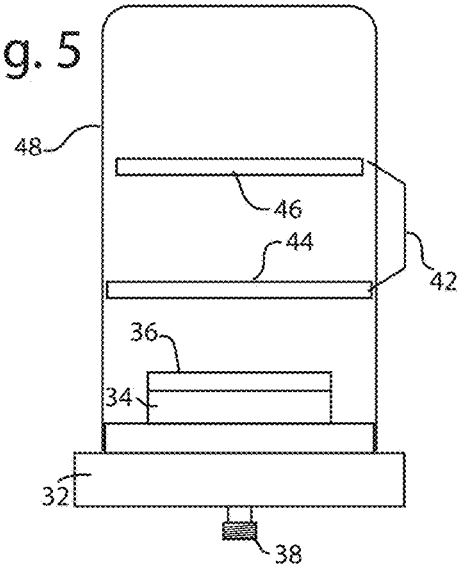
Fig. 6a
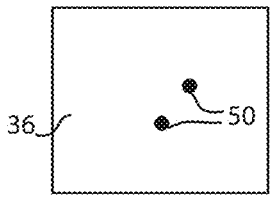
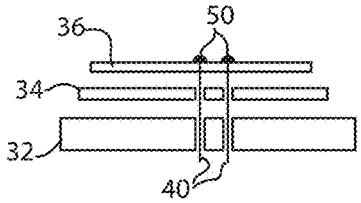
Fig. 6b

DUAL BAND, SINGULAR FORM FACTOR, TRANSMIT AND RECEIVE GNSS ANTENNA WITH PASSIVELY SHAPED ANTENNA PATTERN

TECHNICAL FIELD

The disclosure relates generally to antenna systems for global navigation satellite systems (GNSS). More particularly the disclosure relates to an antenna system which includes a passive focusing component or pattern shaper, usable at dual frequencies, which narrows the antenna beam pattern in a controlled manner that does not rely on active beamforming signal processing.

The antenna system can be used as a receive antenna pointed at the sky to receive GNSS satellite transmissions, while simultaneously inhibiting, both spatially and spectrally, radio interference and jamming signals originating from ground-based or low horizon sources. The same antenna system can also be used as a transmit antenna in a signal retransmission system, broadcasting a re-transmitted signal onto a focused area within a structure that has poor or nonexistent GNSS reception inside.

BACKGROUND

This section provides background information related to the present disclosure which is not necessarily prior art.

The global navigation satellite system (GNSS) employs a constellation of Earth-orbiting satellites that broadcast position and timing data to Earth-based receivers deployed in terrestrial vehicles, aircraft, ships and in handheld devices. Such satellite systems can work at a variety of different frequencies (or wavelengths).

To use the GNSS system for navigation, the GNSS receiver antenna is pointed to the sky, where a plurality of GNSS satellites will typically be visible (in the microwave spectrum). In order to fix a position through triangulation, in normal operation, the receiver antenna must see at least four satellites. Often more than four will be visible, assuming the view of the sky is unobstructed.

The situation is different inside buildings, because buildings may be constructed with steel frames and other building materials which block or substantially attenuate radio transmissions at microwave frequencies. Within buildings, the receiver may only get a lock on four satellites (if at all) when the receive antenna is positioned near a window which has a view of a portion of the satellite constellation, typically in a region of the sky closer to the horizon.

However, there is a problem with low elevation (near horizon) satellite signals. Because of the way radio signals propagate, much of the manmade radio interference arrives via the groundwave path. Thus, satellite transmissions from low elevation locations must compete with groundwave electromagnetic noise generated by all the nearby devices that produce electromagnetic energy in the frequency band used for satellite transmissions. For example, the seemingly innocent LED lightbulb with an inadequately filtered switching power supply can fill the groundwave path with electromagnetic interference, and there are hundreds or thousands of those in use. The high elevation skywave path is less bothered by such manmade noise, simply because there are far fewer devices in line-of-sight at those elevations.

In day-to-day life, much of the groundwave interference is unintentional. Users are turning on and off electronic devices all the time, completely unaware that they may be causing interference with nearby satellite navigation systems. There is, however, a more sinister component. In some instances, particularly in military applications, an adversary may intentionally position a radiating noise source in the groundwave signal path. This might be done, for example, by parking a jamming vehicle near their enemy's receiving station, or by placing a jamming antenna near a facility where blocking of GPS reception is desired.

Many communications systems today use active electronic circuits driving phased array antenna systems to steer the antenna beam towards a desired signal and away from an interfering one. These systems are expensive and require technical expertise to operate.

SUMMARY

Instead of using active electronic beamforming techniques, the disclosed antenna system for a satellite navigation system uses a passive pattern shaping component, making it far less expensive to manufacture, easier to deploy and use and more reliable (having fewer failure points). These advantages make the disclosed antenna idea for rugged military and industrial applications that require satellite communication or satellite navigation services. The disclosed antenna can support communication in multiple bands—a dual band L1 and L2 embodiment is described here.

With dual frequency operation, this antenna when overwhelmed by interferences originating in the L1 band, can switch operations to the GNSS constellations covered in the L2 band, which may have less level of interferers or may be completely free of them, or vice versa (i.e., switch from L2 to L1). This allows the antenna to enable the connected GNSS receiver to continue navigation seamlessly without outages.

The antenna produces a circularly polarized radiation pattern, applicable in both receive and transmit applications. When pointed upwardly, the radiation pattern produces a primary lobe that provides coverage of an area of the sky occupied by a large number of satellites—more than sufficient location triangulation. The radiation pattern is specifically shaped, so that groundwave signals and skywave signals near the horizon are greatly suppressed. This makes the antenna highly immune to manmade radio interference and jamming signals.

In the disclosed embodiment a dual frequency antenna element employs an electromagnetically resonant structure with plural attached current conductors each communicating on a different frequency band. The dual frequency antenna element when electromagnetically energized, produces a circularly polarized radiation pattern with respect to a propagation direction. A pattern shaper element having a longitudinal axis is positioned within the radiation pattern of the dual frequency antenna element with the longitudinal axis substantially aligned with the propagation direction. The pattern shaper comprises first and second substantially circular electrically conductive discs coaxial with the longitudinal axis. The discs have respective first and second surface areas and are secured in a first spaced relation to each other and in a second spaced relation to the dual frequency antenna element. The first and second surface areas, and the first and second spaced relations are cooperatively configured to passively modify the radiation pattern of the dual frequency antenna element to produce dual frequency band coverage of approximately 60 degrees centered about the longitudinal axis while substantially blocking coverage at 90 degrees to the longitudinal axis.

BRIEF DESCRIPTION OF THE DRAWINGS

The drawings described herein are for illustrative purposes only of selected embodiments and not all possible implementations. The particular choice of drawings is not intended to limit the scope of the present disclosure.

FIG. 4 is an exploded perspective view of the antenna with pattern shaper;

FIG. 5 is a diagrammatic cross-sectional view of the antenna;

FIGS. 6*a* and 6*b* provide a detailed view of the dual mode patch antenna;

DETAILED DESCRIPTION

Figure 1:
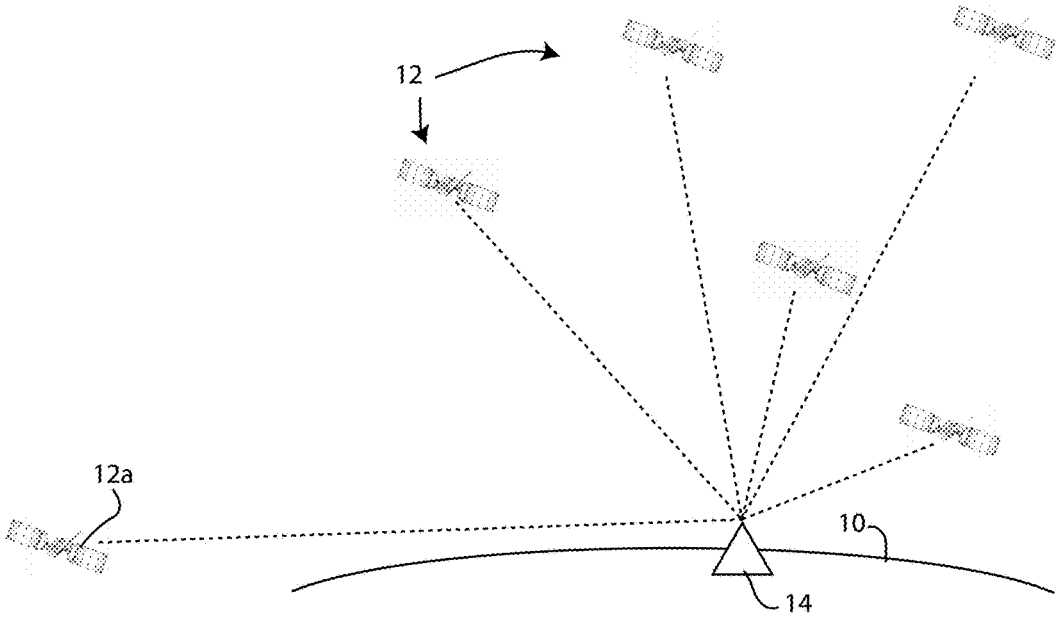
FIG. 1 is a diagram illustrating a portion of a GNSS constellation at different elevation angles relative to the horizon.

Referring to FIG. 1, a portion of an exemplary constellation of global navigation satellites is depicted at 12, including one exemplary satellite 12*a* which happens to be located near the horizon as seen from the vantage point of receive antenna 14 disposed on the ground 10. To get a usable navigational lock, the receive antenna needs to see at least four satellites.

There are a number of different global position and navigation systems in use today. Without limitation, the present detailed description will focus on the global navigation satellite system (GNSS) and in particular, to a satellite system that supports radio transmissions on the L1 and L2 bands. The L1 band is located at 1575.42 MHz, with a nominal wavelength of 19.05 cm; The L2 band is located at 1227.60 MHz, with a nominal wavelength of 24.45 cm.

Figure 2:
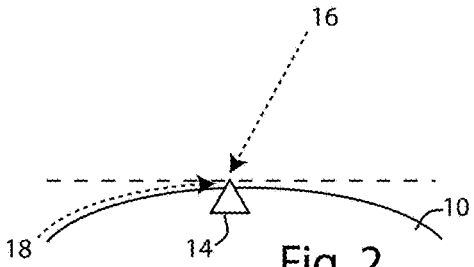
FIG. 2 illustrates a close-up view of a portion of the horizon, differentiating the groundwave and skywave signal paths.

In FIG. 1, while satellite 12*a* is within line-of-sight (skywave) view of the receive antenna 14, reception of signals from satellite 12*a* can frequently be degraded by manmade noise, of either an unintentional or an intentional nature. One reason for this is that antenna 14 receives not only signals from satellites via the skywave path 16, but also manmade signals via the groundwave path 18. See FIG. 2

As noted in the Background section above, the groundwave path can be filled with manmade electromagnetic noise generated by nearby devices producing electromagnetic energy in the frequency band used by the satellite transmissions. This includes devices which are intentionally broadcasting on an L1 or L2 frequency, and devices which are unintentionally generating spurious signals or harmonics in the L1 or L2 frequency bands. WiFi hotspots, computer circuits and switch mode power supplies are among the devices which can generate such electromagnetic interference.

In the military theatre, ground-based or low elevation jamming systems can also interfere with satellite navigation systems. Some jamming systems operate by flooding the receive antenna with so much noise that the receiver can no longer decode the satellite transmissions. Thus navigational services are lost. More sophisticated jamming systems operate by introducing spoofing signals which cause the receiver to provide false navigational information. Thus navigational services are clandestinely rendered untrustworthy.

Figure 3:
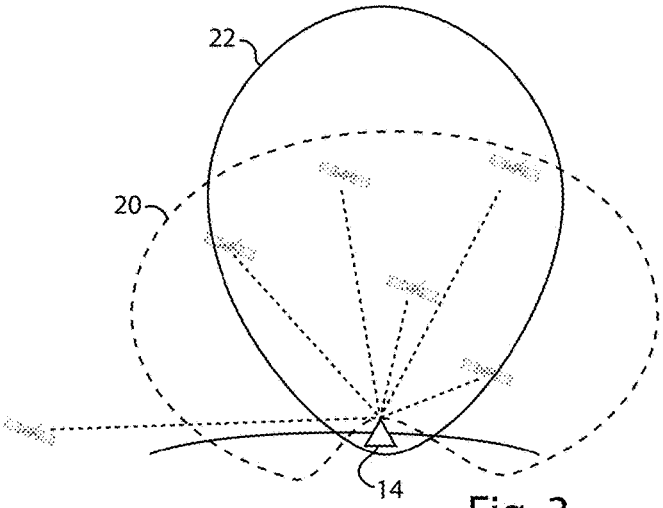
FIG. 3 is a diagram of the constellation of FIG. 1, showing how a suitably focused beam pattern can reduce groundwave signal path without substantially degrading GNSS reception.

Both unintentional and intentional interference with the satellite navigation system can be averted to a large degree by training the receive antenna 14 focus on higher elevation satellites, where there is far less manmade noise, and where spoofing systems are harder to deploy. FIG. 3 illustrates how this may be achieved.

In FIG. 3, the main lobe radiation pattern of a conventional patch antenna is shown by the dashed line 20. The main lobe radiation pattern of the antenna with the disclosed pattern shaper improvement is shown by the solid line 22. Radiation patterns show the coverage of an antenna system at different angles relative to the horizon. As illustrated, pattern 20 of the conventional patch antenna resembles a cardioid pattern which provides coverage at lower elevations, as well as moderate coverage at higher elevations. In contrast, the pattern 22 of the improved antenna system has a beam pattern that is more focused at the higher elevations, and advantageously has very attenuated coverage of low elevation angles near the horizon.

Improved Antenna with Defined Beam Shape

The improved antenna achieves the desirable, moderate beam coverage without the need for expensive or delicate active electronics. Instead, a passive pattern shaper is installed in the radiation pattern of a patch antenna radiator. Although passive in nature, the pattern shaper can achieve desirable results in dual frequency application. The embodiment disclosed here permits dual operation in both the L1 and L2 bands, making it very versatile in a variety of applications. The improved antenna with pattern shaper is shown in FIGS. 4 and 5. FIG. 4 shows the basic components in an exploded perspective view, while FIG. 5 shows those components as assembled in diagrammatic cross section.

Referring to FIG. 4, starting at the feedpoint connector 38 and working up, the improved antenna has two primary components, a patch antenna assembly 30 and a pattern shaper component 42. These primary components are housed under a radome cover 48, which protects the internal components from dust and weather while being essentially transparent to relevant radio frequencies in operation.

A Patch Antenna Embodiment

The patch antenna assembly 30 can be implemented using a variety of different patch or microstrip antenna designs. The disclosed patch antenna has a rectangular conductive element sandwiched above a ground plane element, producing a radiation pattern which is normal to the plane of the patch.

In general, a propagating electromagnetic wave (e.g., radio wave) consists of an electric field (E-field) and a magnetic field (H-field) which, by the laws of physics, are always aligned perpendicular to each other. Electromagnetic energy propagates in a direction that is perpendicular to the plane defined by the electric and magnetic fields. Thus the energy propagated by the patch antenna 30 proceeds outwardly from the plane of the conductive and ground plane elements according to the radiation pattern. The antenna obeys the principle of reciprocity. This means that the radiation pattern which describes the signal strength of a transmitted signal in different directions also describes the signal strength of a received signal from different directions.

Polarization, by convention, describes orientation of the E-field within a propagating electromagnetic wave. Communication between two antennas is strongest if the respective E-fields are aligned parallel to each other. With satellite communication there is often no guarantee that the satellite antenna and the receive antenna will be aligned with E-fields parallel. This is because the satellites are moving and may be rotating about one or more axes.

To address this, the disclosed patch antenna 30 is designed to exhibit circular polarization—the antenna element is constructed so that it provides both a horizontally polarized portion and a vertically polarized portion, the two portions working in concert so that the vector sum of the horizontal and vertical polarizations support transmission and reception at polarization angles in between horizontal and vertical.

Circular polarization is achieved in the patch antenna 30 by positioning the feed wires 40 carrying currents from the conductive element 36 to the connector 38 at asymmetric locations on the conductive element where both horizontally and vertically polarized energy is present. These feed wires and the points of attachment to the conductive element are better seen in FIGS. 6*a* and 6*b*. The placement of feed wire attachment points illustrated in FIGS. 6*a* and 6*b* are approximate (not drawn to precise scale). The circular polarization achieved by antenna 30 is exhibits right-hand circular polarization, corresponding to the convention used by most global navigation satellite systems. There are a variety of ways to achieve right-hand circular polarization, depending on how the patch antenna is constructed. Thus FIGS. 4, 6*a* and 6*b* are intended as examples.

The illustrated embodiment is designed to receive at both L1 and L2 frequencies, without requiring physical adjustment during use. The L1 and L2 frequencies present within the patch antenna assembly, may be combined using a diplexer (not shown), allowing both frequencies to be carried by a common coax transmission line attached to the connector 38.

The patch antenna 30 and pattern shaper 42 work collectively as a beam antenna having a customized antenna pattern that provides a useful view of the sky for GNSS work, while greatly suppressing a view of lower elevations where manmade interference is most often found. The antenna-pattern shaper combination exhibits transmit-receive reciprocity. That is, the illustrated antenna pattern for receiving signals (e.g, from satellites) is the same pattern that would apply if the antenna were used for transmitting signals.

While there are many different patch antenna designs, the patch antenna 30 illustrated here comprises stacked layers of ceramic material carrying conductive foil layers. Closest to the feed point connector 38 is the ground plane layer 32. The ground plane layer is electrically coupled to the outer concentric ring of the connector, thus coupling the ground plane layer 32 to the coax shield (not shown).

Sandwiched on top of the ground plane layer 32 are the dielectric layer 34 and the conductive layer 36. As seen in FIG. 6*b*, two feed wires 50 (one for L1 and one for L2) pass through holes in the ground plane 32, dielectric 34, without making electrical contact. These feed wires also pass through the conductive layer 36 to allow them to be soldered at 50 to the surface of the conductive layer 36. The sandwiched relationship of the ground plane 32 and conductive layer 36 define a resonant cavity, filled by the dielectric layer 34. This resonant cavity, along with the conductive layer 36 work in concert to define an antenna structure which is capable of converting electromagnetic waves into current flow and vice versa according to Maxwell's equations.

Besides the patch antenna design described above, other antenna designs may be used to implement the defined beam shape, including cavity resonators, spiral antennas, patch antennas, microstrip antennas, loop antennas and the like. Each of these antennas can be outfitted with the pattern shaper described next.

Pattern Shaper Component

As seen in FIGS. 4 and 5, the pattern shaper component 42 comprises a plurality of conductive discs. In the embodiment illustrated, the pattern shaper component 42 comprises a first disc 44 and a second disc 46. These discs are spaced apart as seen in FIG. 5 and also respectively spaced apart from the patch antenna assembly 30. These discs are circular (of different diameters) and made from an electrically conductive material such as aluminum or copper.

An analysis of GPS coverage shows that one has less than 10% probability of finding a satellite if the beam is only 20 degrees wide facing directly up. At a 60 degree beam width, the chances of finding a valid space vehicle (e.g. satellite) are above 80%. Most of the ground based interferences arrive in the 10-15 degree elevation, and are almost nonexistent at elevations approaching 40 degrees. So the nulls placed at the sides and the beam width of 60 degrees facing the zenith gives the best combination to have valid space vehicles tracked by the antenna. The following exemplary dimensions may be used to achieve the desired 60 degree beam width.

Exemplary Dimensions:

Top disc: 2.826" dia.

Bottom disc: 3.122" dia.

Gap between discs: 1.681"

Gap from top of antenna elements to bottom disc: 1.25".

As previously noted, the pattern shaper is a passive component, which works without the need for active beam forming signal processing or complex phased array antennas. The plural discs produce the electromagnetic effect of a leaky waveguide, which slows the phase velocity of the electromagnetic energy propagating into and out from the patch antenna assembly along the axis of the antenna element and discs. The energy "leaked" (re-radiated) from the periphery of this waveguide, if properly phased, combines with the energy produced by patch antenna to produce the pattern shape desired.

Designing the Pattern Shaper

By suitably selecting the number and inter-spacing of the discs, the phase velocity through the pattern shaper (leaky waveguide structure) may be controlled. By suitably adjusting the spacing between the pattern shaper and the patch antenna, the phasing of the coupling between antenna and pattern shaper can also be controlled. Thus, for any given end goal design, these disc number and spacing parameters can be iteratively adjusted via a computer model until the desired end goal is achieved. For the use case described here, two discs were found to be suitable. It is also possible to iteratively adjust other parameters, such as the disc diameters. Doing so may be useful in fine tuning the impedance of the antenna-pattern shaper combination.

With reference to the exemplary dimensions given above, several observations are noted. First, the top disc (second disc 46 in FIGS. 4 and 5) is smaller in diameter than the bottom disc (first disc 44 in FIGS. 4 and 5). Thus, the top disc (second disc 46) has an 18% smaller surface area, and correspondingly less capacitance than the bottom disc (first disc 44). Second, the gap between the two discs 44 and 46 is approximately 34.5% greater than the gap between the pattern shaper (first disc element 44) and the antenna element. Stated differently, the gap between the pattern shaper (first disc element 44) and the antenna element is approximately 25.6% smaller than the gap between the pattern shaper elements.

When the pattern shaper discs and antenna element are considered as discrete elements which capacitively couple to one another, it can be seen how increasing the surface area of an element or reducing the spacing between elements will increase the localized capacitive coupling. Conversely, reducing surface area or increasing spacing will decrease the localized capacitive coupling. Such changes in capacitive coupling will affect the localized phase velocity of the electromagnetic wave, reducing by a controlled amount the velocity as compared to the speed of light in a vacuum. Thus, by adjusting these surface areas, and spacing parameters, it is possible to alter the radiation pattern shape to achieve the desired result.

In practice these parameters may be most conveniently ascertained iteratively by numerically integrating the antenna pattern using computational electromagnetic modeling, such as method of moments (MoM), finite element method (FEM), and finite difference time domain (FDTD) methodologies.

Figure 7:
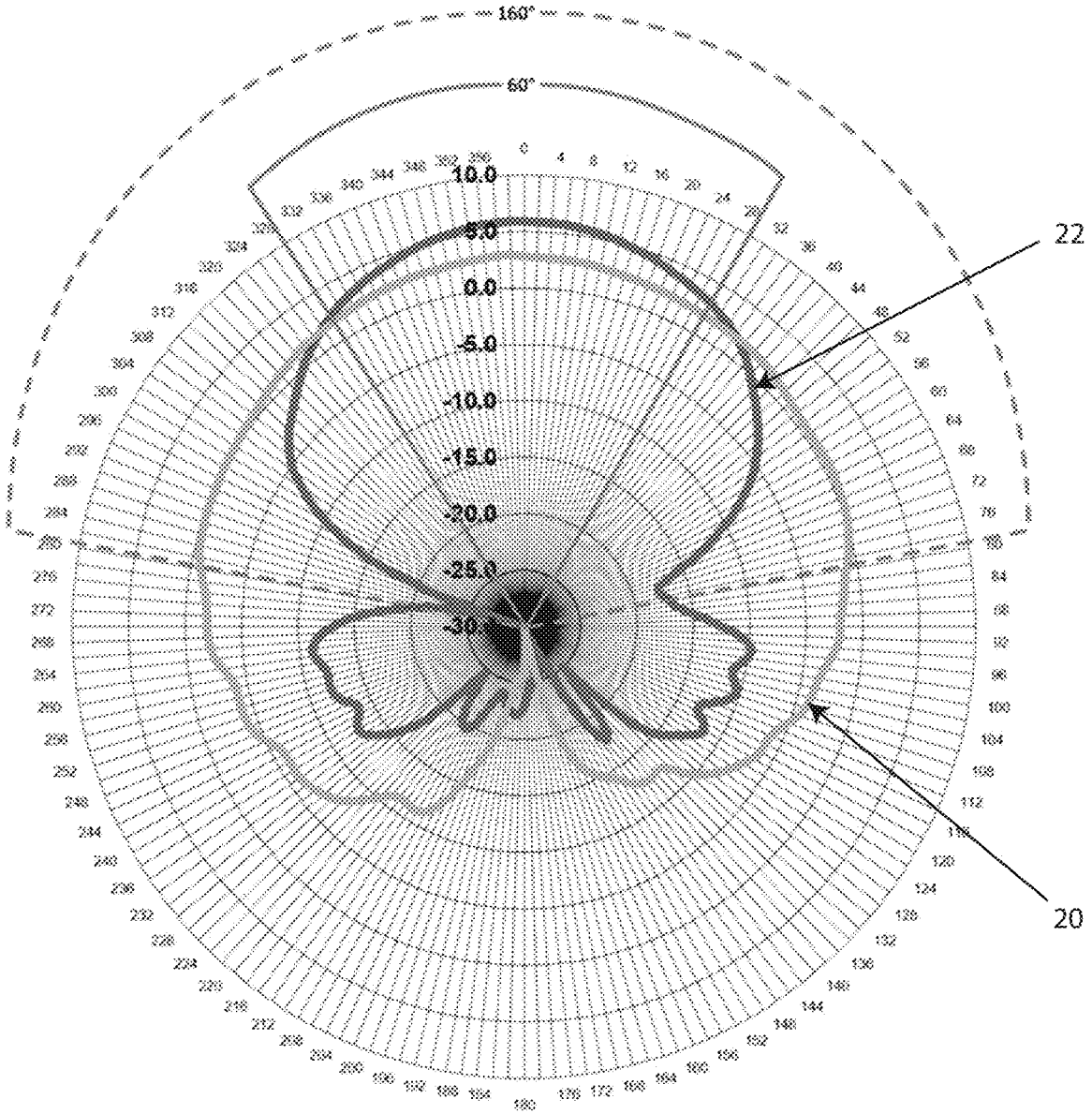
FIG. 7 is a graph comparing the antenna radiation pattern with and without the pattern shaper.

FIG. 7 shows the measured antenna pattern for an antenna-pattern shaper combination according to the measurements outlined above. The graph shows actual implementation results, measured from a physically realized design. As seen, the desired 60 degree pattern is achieved, as shown at 22. For comparison, the pattern without the beam shaper is shown at 20.

Use Case A

Figure 8:
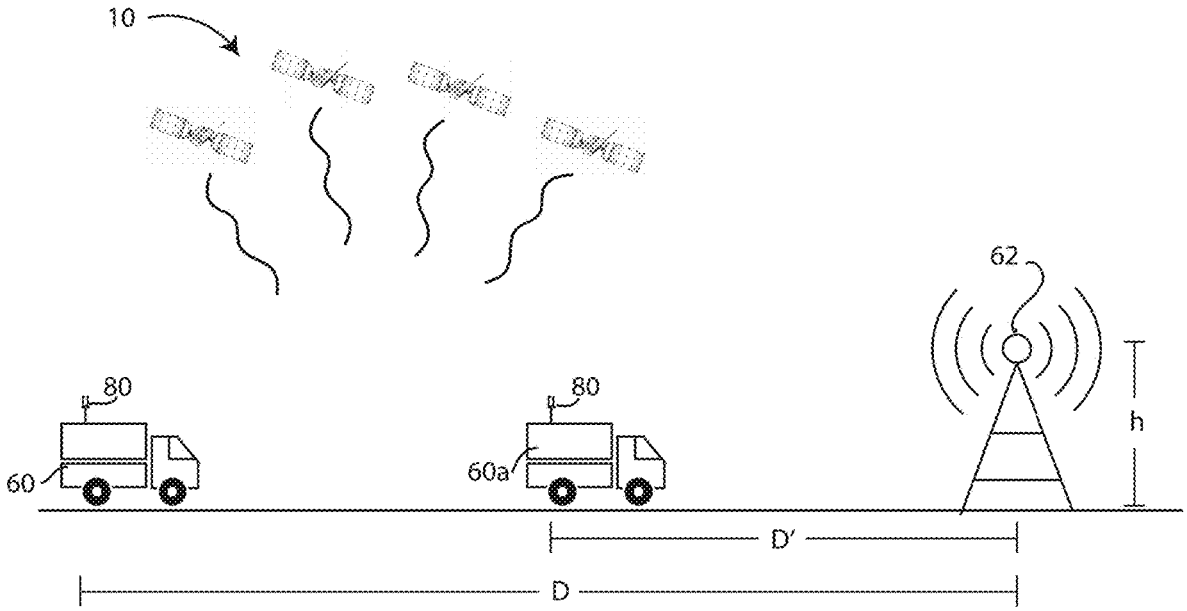
FIG. 8 is a live sky jamming use case, comparing use of focused antenna vs conventional.

FIG. 8 illustrates a first use case of the improved antenna-pattern shaper combination where a vehicle 60 carries the antenna assembly with pattern shaper 80 to receive navigation transmissions (or other informational transmission) from the satellite constellation 10. In this use case, a jamming transmission source 62 is located a distance D from the vehicle's initial location. The purpose of the jamming transmission in this use case is to protect a region of territory surrounding the transmission source. By placing the transmission source on a tower of height h, the jamming system is constructed to interfere with satellite reception by vehicles as they approach.

In one experiment, where height h was much less than distance D the following results were observed:

- Without pattern shaper: vehicle 60 saw less than 4 valid satellite signal transmissions due to its uniform gain pattern in the hemisphere—capturing jammer signals arriving from low elevations and using those signals in the navigation solution, thus rendering the system unable to decode satellite transmissions at distance D=8 miles from the transmission source.
- With pattern shaper: vehicle 60 continued to see 4 valid satellite signal transmissions from high elevation satellites—using its higher gain towards the zenith and ignoring the jammer signals arriving at low elevation angles due to nulls pointed in the low angle direction. This allowed the vehicle to decode satellite transmissions at distance D=8 miles and to continue to decode satellite transmissions until D'=1 mile was reached.

Use Case B

Figure 9:
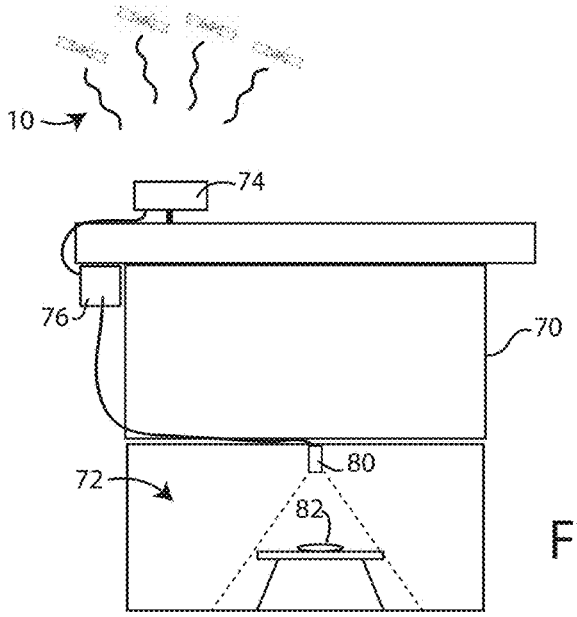
FIG. 9 is an inside-building use case.

FIG. 9 illustrates a second use case of the improved antenna-pattern shaper combination, where the antenna assembly with pattern shaper 80 is used in transmit mode. It will be recalled that the pattern shape obtained for the antenna in receive mode (such as use case A) is the same pattern shape for a transmit mode use case, due to reciprocity.

In this use case, the occupants of building 70 wish to use data from the satellite constellation 10, but the steel and concrete structure of their multistory building prevent those satellite signals from reaching them.

Thus, the antenna assembly with pattern shaper 80 is mounted on the ceiling inside the work area 72 where a GNSS receiver 82 is positioned on a table. That receiver 82 cannot receive transmissions from the satellites 10 because those signals are blocked by the building.

The solution is to mount a receive antenna 74 on the roof of the building where it has a clear view of the satellite constellation 10. If desired, the receive antenna 74 can be outfitted with a second pattern shaper using the same design as describe above. The output of antenna 74 is then fed by coax to a low noise amplifier 76, which then distributes the amplified signal to the ceiling mounted antenna-pattern shaper 80. The antenna-pattern shaper 80 when rebroadcasts the amplified signal into the work area 72 within the building, allowing the GNSS receiver 82 to obtain a navigation lock. In implementing this use case an FCC licensed GNSS retransmission system should be used, as FCC regulations forbid repeating (retransmission) of GPS/GNSS signals without a proper license.

From the foregoing, it will be appreciated that the antenna with passive pattern shaper offers important advantages. Without the need for any expensive active beam-forming components, and without the need to make any changes in the field, it can support dual band transmit and receive operation. Being able to work at both L1 and L2 frequencies simultaneously effectively gives this antenna the performance of a broadband antenna, but without the need for expensive broadband amplifiers—the supporting transceiver electronics can handle L1 and L2 communications using only a simple diplexer signal feed.

Active signal processing and phased array antenna systems based on beamforming typically require a minimum of 10 watts to function with currently available DSP technology. In contrast, the disclosed antenna with passive shaper can function without system supplied power to create the beam pattern (i.e., the passive shaper requires no power). Thus a system based on the disclosed antenna with passive shaper will cost only about a quarter of a watt, to provide the additional amplification from the low noise amplifier.

Being capable of both transmit and receive modes, without modification is another big advantage not found in complex active beam-forming systems. With this antenna, field technicians can readily adapt a vehicle mounted antenna 80 (FIG. 8 receive antenna use case) for an ad hoc indoor retransmission application (FIG. 9 transmit antenna use case).

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment as contemplated herein. It should be understood that various changes may be made in the function and arrangement of elements described in an exemplary embodiment without departing from the scope of the invention as set forth in the appended claims.

What is claimed is:

1. An antenna system for a satellite navigation system comprising:

a dual frequency antenna element having an electromagnetically resonant structure with plural attached current conductors each communicating on a different frequency band;

the dual frequency antenna element when electromagnetically energized, producing a circularly polarized radiation pattern with respect to a propagation direction;

a pattern shaper element having a longitudinal axis and positioned within the radiation pattern of the dual frequency antenna element so that the longitudinal axis is substantially aligned with the propagation direction;

the pattern shaper comprising first and second substantially circular electrically conductive discs coaxial with the longitudinal axis, the discs having respective first and second surface areas and being secured in a first spaced relation to each other and in a second spaced relation to the dual frequency antenna element;

the first and second surface areas, and the first and second spaced relations being cooperatively configured to passively modify the radiation pattern of the dual frequency antenna element to produce dual frequency band coverage of approximately 60 degrees centered about the longitudinal axis while substantially blocking coverage at 90 degrees to the longitudinal axis.

2. The antenna system of claim 1 wherein the dual frequency antenna element is a patch antenna having a ground plane element which defines a plane and wherein the propagation direction is substantially perpendicular to the plane.

3. The antenna system of claim 1 wherein the first and second discs each comprise substantially planar circular plates.

4. The antenna system of claim 1 wherein the first and second discs are each made of aluminum or other metal.

5. The antenna system of claim 1 wherein the first disc is positioned closer to the antenna element than the second disc and wherein the first disc has a larger surface area than the second disc.

6. The antenna system of claim 1 wherein the first disc is positioned closer to the antenna element than the second disc and wherein the first disc is disposed closer to the antenna element than the first spaced relation.

7. The antenna system of claim 1 wherein the plural current conductors are coupled to a receiver.

8. The antenna system of claim 7 wherein the receiver is a satellite navigation system receiver and wherein the longitudinal axis of the pattern shaper is directed skyward.

9. The antenna system of claim 1 wherein the plural current conductors are coupled to a transmitter.

10. The antenna system of claim 9 wherein the longitudinal axis of the pattern shaper is directed into a space where reliable reception of skywave signals from a satellite navigation system is unavailable.

* * * * *